United States Patent [19]

Hetherington

[11] 4,022,094

[45] May 10, 1977

[54] TRIMMER FOR LUMBER PACKAGES

[76] Inventor: Ronald Malcolm Hetherington, 450 MacBeth Crescent, Vancouver, British Columbia, Canada, V7T 1V7

[22] Filed: May 19, 1976

[21] Appl. No.: 688,103

[52] U.S. Cl. ..... 83/409; 83/420; 83/421; 83/422; 83/425.2; 83/425.4; 83/435.1; 83/411 R

[51] Int. Cl.[2] ..... B27B 5/04

[58] Field of Search ..... 83/409, 411 R, 420, 83/421, 422, 425.2, 425.3, 425.4, 435.1, 435.2, 437, 516, 517

[56] References Cited

UNITED STATES PATENTS

| | | | |
|---|---|---|---|
| 262,611 | 8/1882 | Nichols et al. | 83/411 R |
| 1,093,680 | 4/1914 | Beck et al. | 83/733 |
| 2,393,617 | 1/1946 | De Spain | 83/411 R |
| 2,501,299 | 3/1950 | Anderson | 83/425.4 |
| R28,840 | 6/1976 | Sarring | 83/517 |

*Primary Examiner*—Donald R. Schran
*Attorney, Agent, or Firm*—Fulwider, Patton, Rieber, Lee & Utecht

[57] ABSTRACT

A trimmer for a lumber package. The trimmer comprises a reciprocating, retaining carriage to receive the lumber package. A first track. Means reciprocate the retaining carriage along the first track from a loading position through a second position. Cutting means on each side of the track at the second position trim the lumber package. Compressor means are reciprocable at the loading position to compress a lumber package in a direction substantially perpendicular to the first track. Releasable retaining means hold the lumber package in a predetermined, fixed position on the retaining carriage as it moves from the loading position through the second position and is trimmed.

11 Claims, 4 Drawing Figures

2
2
3
3
4
4
2
4
6
8
10
16
18
18
20
22
24
24
24
24
26
26
28
28
32
32
34
34
36
36
38
38
40
40
42
42
44
46
46
48
48
48
48
50
50
62
64
64
66
66
70
70
70
70
74
74
76
76
78
78
78
78
80
80
82
90
90
94
94
98
98
102
102
108
108

86
90
94
88
96
66
92
86
26
30
40
98
6
102
2
106
100
4
104
108
8
30
42
20
12
110
76
24
24
24
82
16
12
14
76
78
44
50
60
46
22
18
74
62
74

TRIMMER FOR LUMBER PACKAGES

FIELD OF THE INVENTION

This invention relates to a trimmer for a lumber package.

DESCRIPTION OF PRIOR ART

Lumber is normally shipped in standard lengths in packages of standard size. It is normally trimmed to an appropriate size, for example, for building purposes, by the receiving lumber dealer. In the prior art, it has been the practice for the receiving lumber dealer to dismantle the packages received and to trim the individual pieces of lumber to the required lengths using a bandsaw. The process is expensive of labour in feeding the lumber through the machine and, in particular, is wasteful in that it breaks down the packaged lumber. After cutting the required lengths the second dealer then re-packages.

SUMMARY OF THE INVENTION

The present invention seeks to avoid the above disadvantages by providing a trimmer for lumber that is able to trim the lumber as a package. The trimmer of the present invention is extremely economical of labour in the actual trimming operation and does not necessitate the breaking down of the first lumber package by the receiving dealer with consequent re-packaging after trimming. Using the trimmer of the present invention the packaged lumber may be trimmed to standard lengths without the packaging, usually metal bands, being removed.

Accordingly, in its broadest aspect, the present invention is a trimmer for a lumber package comprising a reciprocating, retaining carriage to receive the lumber package, a first track, means to reciprocate the retaining carriage along the first track from a loading position through a second position, cutting means on each side of the track adjacent the second position to trim the lumber package, compressor means reciprocable at the loading position to compress a lumber package in a direction substantially perpendicular to the first track and releasable retaining means to hold the lumber package in a predetermined, fixed position on the retaining carriage as it moves from the loading position through the second position and is trimmed.

BRIEF DESCRIPTION OF DRAWINGS

An embodiment of the invention is illustrated in the accompanying drawings in which.

DESCRIPTION OF PREFERRED EMBODIMENT

Figure 1:
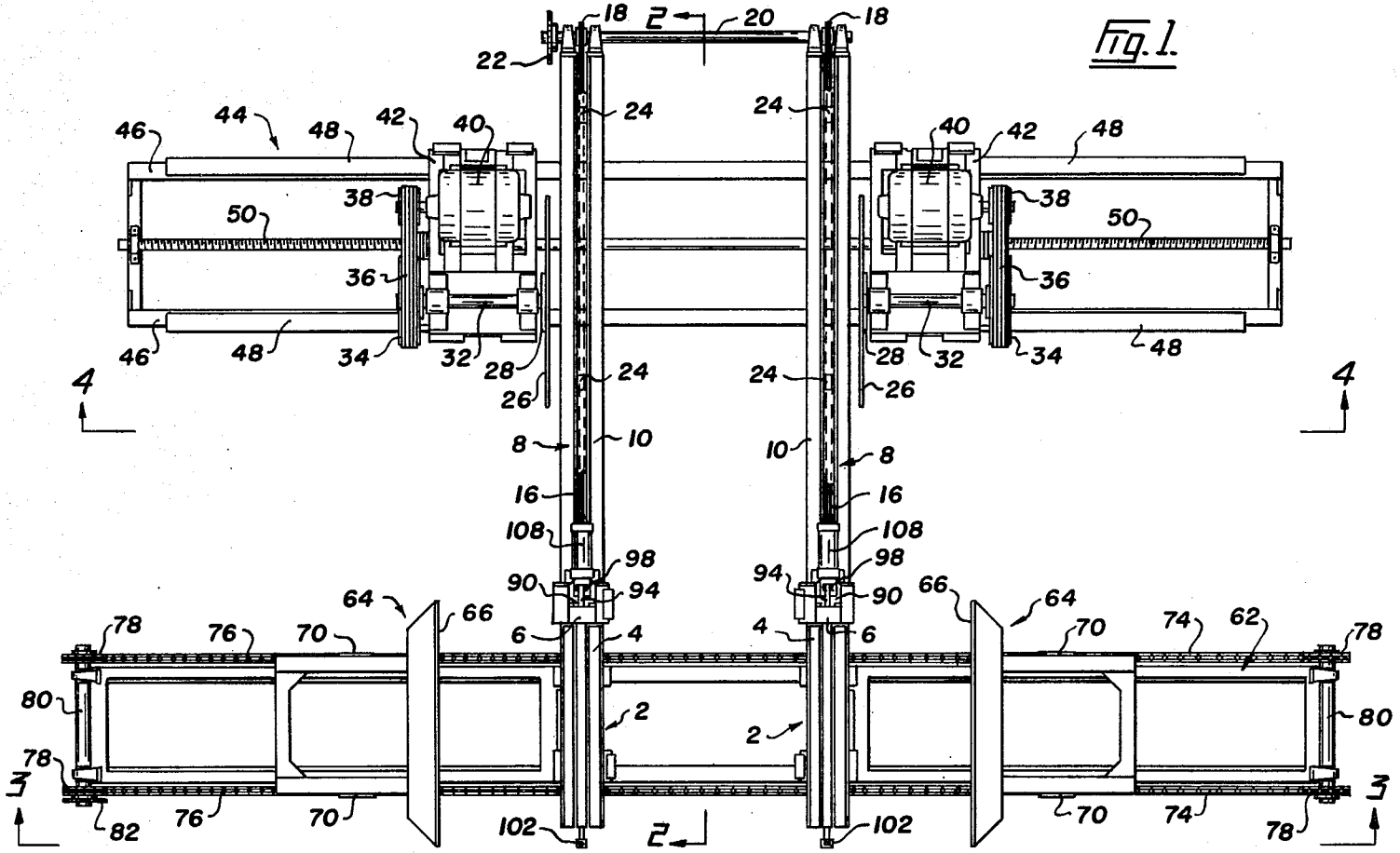
FIG. 1 is a general, plan view of a trimmer according to the present invention.

The drawings illustrate a trimmer for a lumber package. The trimmer comprises a reciprocating, retaining carriage made up of two spaced members 2. Each member 2 comprises a base 4 and an upstanding wall member 6. The trimmer includes a first track made up of rails 8. Each rail 8 is made up of a pair of spaced members 10.

Figure 2:
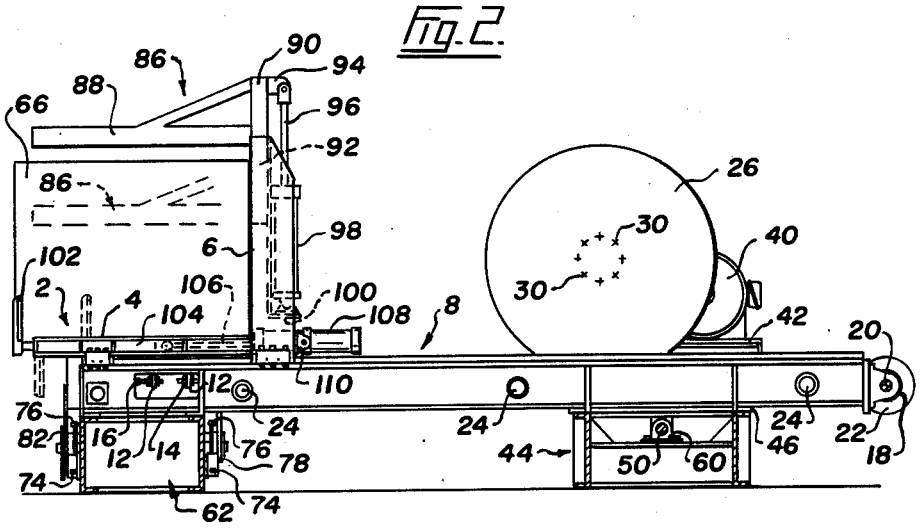
FIG. 2 is a section along the line 2—2 in FIG. 1.

As indicated in FIG. 2, the members 2 are provided with downwardly projecting extensions 12 that engage between the spaced members 10 of the rails 8. Each downward projection 12 is provided with a connector 14 to attach it to an endless chain 16. Each chain 16 passes over sprockets 18 positioned on a shaft 20 at one end of the machine. Shaft 20 is driven by suitable drive to a sprocket 22. At the other end of the machine there are idler sprockets (not shown) over which the endless chain 16 passes back to a connector 14. The drive means (not shown) that drive sprocket 22 and, hence the members 2 of the retaining carriage, are reversible so that the members 2 may be reciprocated back and forth along the first track made up by the rails 8. The first track is provided with spacers 24 to locate the rails 8 in position and also to act as separators for the runs of the endless chain 16.

The endless chain 16 reciprocates the retaining carriage made up of the members 2 from a first, loading position--in which it is shown in FIG. 1--towards the drive shaft 20. When the carriage passes along the rails 8 that make up the first track, it passes through a second position defined by circular saws 26 positioned on each side of the first track. In the illustrated, preferred embodiment the circular saws 26 are mounted on arbors 28 by bolts 30 (see FIG. 2). The arbors are mounted on borne shafts 32. On the end of each shaft 32, remote from the circular saw 26, there is a pulley 34. Pulley 34 is rotated by a belt 36 that engages on a drive pulley 38 mounted on the drive shaft of an electric motor 40.

Figure 4:
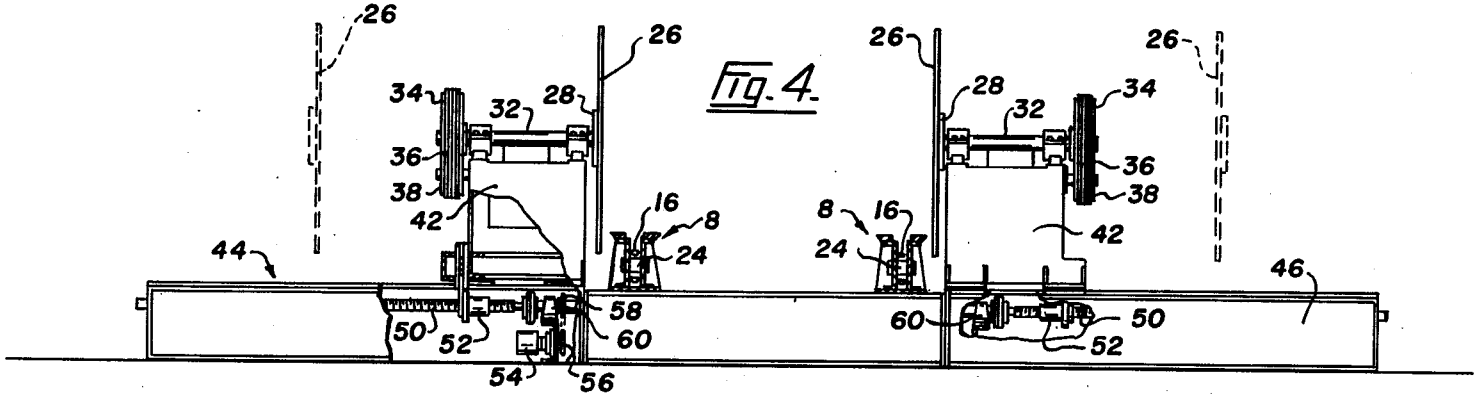
FIG. 4 is a section along the line 4—4 in FIG. 1.

The circular saws 26 are mounted on saw carriages 42. Although not essential to the invention in the illustrated, preferred embodiment the saw carriages 42 reciprocate on a track 44 made up of spaced members 46 having upper, sliding surfaces 48 on which the saw carriages 42 slide. The saw carriages may be moved to a predetermined position by sliding them on the sliding surfaces 48 utilizing screw shaft 50. Shaft 50 engages threaded collars 52 extending downwardly from the base of the saw carriage 42. A hydraulic motor 54 turns the screw shaft 50 by a turning sprocket 56 which is engaged with sprocket 58 mounted on the screw shaft 50. As illustrated in FIGS. 1 and 4 the screw shaft 50 is also located by journals 60 which are located on the frame of the track 44.

Each collar 52 has a thread that differs in its hand from the other collar 52. By this means, one rotation of the shaft 50 will ensure that both circular saws 26 move in opposite directions relative to the track 44. That is, each circular saw 26 moves outwardly when the other circular saw 26 moves outwardly and inwardly when the other saw 26 moves inwardly. By this means the saws 26 can be set symmetrically about the center line of the rails 8. Accuracies of ± one sixty-fourth of an inch have been obtained.

Figure 3:
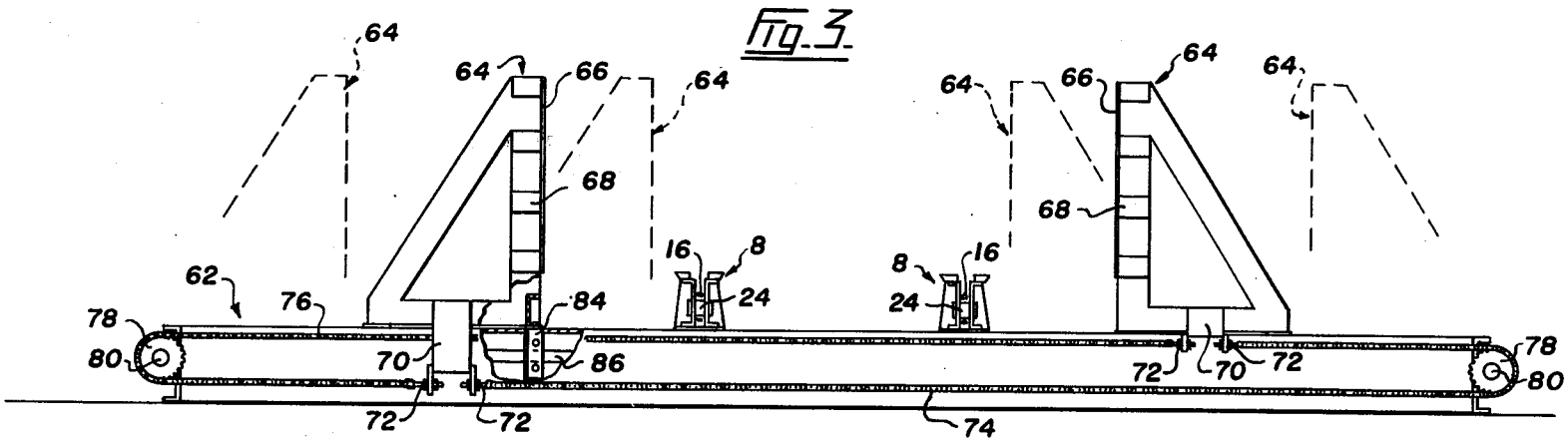
FIG. 3 is a section along the line 3—3 in FIG. 1.

Adjacent the loading position shown in FIG. 1, a further track 62 is positioned. This track, which extends outwardly on each side of the rails 8, defines a pathway for compressor members 64 that are reciprocable on the track 62. The function of compressor members 64 is to compress longitudinally the pieces of lumber that make up the lumber package and to arrange the packages of lumber symmetrically about the center line of the rails 8. To do this each compressor means 64 has an end surface 66. As indicated most clearly in FIG. 3 the compressor member 64 are simple frames made up of rectangular tubular members 68. Plates 70 extend downwardly from each outer side of each compressor member 64. The plates are provided with chain engagement links 72 to facilitate engagement with two chains 74 and 76. It should be noted that plates 70 are of differing lengths. For the compressor member 64 on the right of FIG. 3 the plates 70 are relatively short since they need only engage the upper run of the chains 74 and 76. The plates 70 on the left hand member 66 are longer to engage the lower run of the chains 74 and 76. The chains 74 and 76 pass around sprockets 78 positioned at each end of the track 62. The sprockets 78 are mounted on shafts 80. One of the shafts-- the left hand shaft in FIG. 1--is provided with a drive sprocket 82 so that the chains 74 and 76 may be driven to move the compressor members 64 inwardly and outwardly on the track 62. It will be noted that the attachment of the chains 74 and 76 to the compressor members 64 via plates 70 and chain engagement links 72 is such that the two members 64 always move in opposed directions relative to the track 62. That is the two members 64 move inwardly together or outwardly together relative to the track 62. That is the two members 64 move inwardly together or outwardly together relative to the track 62.

Compressor members 64 are provided with roller means (not shown) but positioned within a bracket 84 extending downwardly from the compressor members 64. There is a bracket 84 with rollers at each side of the track 62 The roller runs against a runner 86 running the length of the track 62.

The apparatus according to the present invention is provided with releasable retaining means to hold a lumber package in a predetermined, fixed position on the retaining carriage made up of the members 2. These releasable retaining means hold the package as it moves from the loading position for the members 2 between the circular saws 26.

As illustrated in FIG. 2, vertical retention of the lumber package is carried out by a vertical dog 86. The horizontal limb 88 of the dog 86 contacts the top of a lumber package as the package sits on the base 4 of the retaining members 2. Limb 88 is attached to a vertical limb 90 which is slidably engaged in a tubular pathway 92 formed behind the wall member 6 of the retaining member 2. The vertical limb 90 is provided with a flange 94 to which is attached the connecting rod 96 of a pneumatic cylinder 98. The cylinder 98 is located at the end remote from the rod 96 on a platform 100 substantially perpendicular to the wall member 6. The arrangement is such that when air is applied to the cylinder 98 horizontal limb 88 of the vertical dog 86 is forced downwardly to compress a lumber package against the base 4 of a holding member 2 and retain it in position.

The lumber package is prevented from sliding backwardly on the retaining member 2 by the provision of a horizontal dog 102. Dog 102 is attached to a slider 104 that is a close, sliding fit within the base 4 of the retaining members 2. As illustrated in FIG. 2, the dog can be rotated downwardly so that it does not hinder loading of the lumber onto the members 2 of the retaining carriage. Dog 102 is attached to the connecting rod 106 of a pneumatic cylinder 108 mounted on a member 2 at 110. When a lumber package has been positioned on the members 2 air can be supplied to the pneumatic cylinders 108 causing the dogs 102 to move inwardly, towards the wall members 6 of the members 2, to compress and retain the lumber package in position.

In use the illustrated apparatus works as follows:

The circular saws 26 are set to the desired spacing, that is are at a distance equal to the required length of lumber. In the illustrated preferred embodiment lumber may be cut from any length from about 6 feet to about 17 feet. However, it will be appreciated that these figures can be varied by simple alteration of the dimensions of the machine. When the saws have been set, the lumber package is loaded onto the retaining carriage made up of members 2. First, the package is squeezed longitudinally and centered by forcing compressor members 64 inwardly. To do this an appropriate drive is applied to the drive sprocket 82 and the compressor members 64 are moved inwardly until they contact and squeeze and center the lumber package. Air is then applied to pneumatic cylinders 98 and 108 so that the lumber package is retained on the members 2 of the retaining carriage. Compressor members 64 are then withdrawn outwardly and drive is applied to the members 2 by applying a drive to the sprockets 22 on the shaft 20. Electric motors 40 for the saws 26 are started and the lumber package on the members 2 is moved toward and then between the rotating blades 26. The whole package is trimmed to the required length. At the end of the run, that is after all the package has passed through the saws 26 the air is withdrawn from the pneumatic cylinders 98 and 108 and the vertical dogs 86 and the horizontal dogs 102 are withdrawn from contact with the lumber package. Dogs 102 are pivoted downwardly and the lumber package is then removed from the members 2. The members 2 are returned to the loading position and the procedure repeated.

An interesting and novel aspect of the invention is that the lumber packages move through the eyes or centers of the circular saws 26 in the illustrated embodiment. A balk of solid lumber having the dimensions of a typical lumber package could not be cut in the illustrated machine. Before the balk had been cut through its leading edge would contact the arbors 28 of each saw 26 and the thickness of a lumber package is typically greater than the distance from the periphery of an arbor 28 to the periphery of a circular saw 26 mounted on that arbor 28. However, if the lumber packages are made up of a large number of small pieces whose thicknesses are smaller than the above distance between the peripheries the machine can trim the package and the cut pieces fall to the ground or, preferably, to a refuse conveyor positioned beneath the saws 26.

The framework of the machine is of conventional industrial design. It is desirably made up of C-angle metal bar.

The means of operating the drive shaft is not important. An internal combustion motor may be used or electric, hydraulic or pneumatic power may be used.

I claim:

1. A trimmer for a lumber package comprising:

a reciprocating, retaining carriage to receive the lumber package;

a first track;

means to reciprocate the retaining carriage along the first track from a loading position through a second position;

cutting means on each side of the track at the second position to trim the lumber package;

compressor means reciprocable at the loading position to compress a lumber package in a direction substantially perpendicular to the first track; and releasable retaining means to hold the lumber package in a predetermined, fixed position on the retaining carriage as it moves from the loading position through the second position and is trimmed.

2. A trimmer as claimed in claim 1 in which the first track comprises spaced rails.

3. A trimmer as claimed in claim 1 in which the reciprocable retaining carriage comprises two spaced members each comprising a base and an upstanding wall member;

a first retaining means on each spaced member able to force a lumber package against the upstanding wall; and a second retaining means on each spaced member able to force a lumber package against the base.

4. A trimmer as claimed in claim 3 in which the first and second retaining means are abutment means are attached to a reciprocable drive member.

5. A trimmer as claimed in claim 4 in which the drive members are pneumatic cylinders.

6. A trimmer as claimed in claim 3 in which each spaced member is attached to one end of a chain, the chain extending from the spaced member over a drive sprocket at the end of the first track, along the first track, over an idler sprocket at the other end of the track and back to an attachment on the spaced member whereby each spaced member may be moved up and down the track.

7. A trimmer as claimed in claim 6 in which the drive sprockets for each chain are mounted on a single drive shaft.

8. A trimmer as claimed in claim 1 in which the cutting means is mounted on a track to reciprocate inwardly and outwardly relative to the first track.

9. A trimmer as claimed in claim 1 in which the cutting means are two circular saws, each supported on an arbor and each positioned at a side of the first track.

10. A trimmer as claimed in claim 9 in which each saw is mounted on a carriage;

an electric motor mounted on each carriage to drive the saw through a belt drive.

11. A trimmer for a lumber package comprising:

a first track;

reciprocable receiving means on the first track to receive and rigidly retain a lumber package;

means able to reciprocate the receiving means along the first track from a first, loading position through a second, cutting position;

a second track extending transverse to the first track and extending outwardly from each side of the first track from the loading position;

an end compressor and centering member reciprocable on said second track to compress longitudinally and center a lumber package positioned on the receiving means;

a third track extending transverse of the first track and extending from each side of the first track adjacent the cutting position; and cutting members on each side of the first track reciprocable on said third track to trim a lumber package to a required length as the passage passes between them.

* * * * *